US010834509B2

(12) United States Patent
Fu

(10) Patent No.: US 10,834,509 B2
(45) Date of Patent: Nov. 10, 2020

(54) MICROPHONE AND MANUFACTURE THEREOF

(71) Applicants: Semiconductor Manufacturing International (Shanghai) Corporation, Shanghai (CN); Semiconductor Manufacturing International (Beijing) Corporation, Beijing (CN)

(72) Inventor: GuangCai Fu, Shanghai (CN)

(73) Assignees: SEMICONDUCTOR MANUFACTURING INTERNATIONAL (SHANGHAI) CORPORATION (CN); SEMICONDUCTOR MANUFACTURING INTERNATIONAL (BEIJING) CORPORATION (CN)

( * ) Notice: Subject to any disclaimer, the term of this patent is extended or adjusted under 35 U.S.C. 154(b) by 0 days.

(21) Appl. No.: 15/925,587

(22) Filed: Mar. 19, 2018

(65) Prior Publication Data

US 2018/0279058 A1 Sep. 27, 2018

(30) Foreign Application Priority Data

Mar. 24, 2017 (CN) ..... 2017 1 0180170

(51) Int. Cl.
*H04R 19/04* (2006.01)
*H04R 1/04* (2006.01)
(Continued)

(52) U.S. Cl.
CPC ..... *H04R 19/04* (2013.01); *H04R 1/04* (2013.01); *H04R 19/005* (2013.01); *H04R 31/00* (2013.01)

(58) Field of Classification Search
CPC ..... H04R 19/04; H04R 19/005; H04R 31/00; H04R 1/04
See application file for complete search history.

(56) References Cited

U.S. PATENT DOCUMENTS

2011/0108838 A1* 5/2011 Kageyama ..... B06B 1/0292 257/49
2014/0001584 A1* 1/2014 Liu ..... B81C 1/00158 257/419

(Continued)

FOREIGN PATENT DOCUMENTS

CN 104796832 A 7/2015

*Primary Examiner* — Andrew C Flanders
(74) *Attorney, Agent, or Firm* — Innovation Counsel LLP

(57) ABSTRACT

A microphone and its manufacturing method, relating the semiconductor techniques, are presented. The microphone comprises: a substrate comprising an opening, a first electrode layer at the bottom of the opening, and at least one groove adjacent to the first electrode layer, with the groove and the opening on two opposing sides of a bottom surface of the first electrode layer; a separation material layer filling the groove; and a second electrode layer on the separation material layer, wherein the first electrode layer, the separation material layer, and the second electrode layer form a cavity. In this inventive concept, the separation material layer on the groove works as an anchor node embedding in the substrate to increases the effective contact area and the bonding power, and to improve the bonding quality between the second electrode layer and the substrate, which results in a strengthened second electrode layer.

9 Claims, 9 Drawing Sheets

(51) Int. Cl.
*H04R 19/00* (2006.01)
*H04R 31/00* (2006.01)

(56) References Cited

U.S. PATENT DOCUMENTS

2014/0003633 A1* 1/2014 Liu ..... H04R 1/04
381/174
2014/0105428 A1* 4/2014 Zoellin ..... H04R 23/00
381/174
2014/0109680 A1* 4/2014 Tsai ..... G01L 11/04
73/702
2014/0219062 A1* 8/2014 Rothberg ..... B81B 3/0021
367/135
2015/0129992 A1* 5/2015 Hur ..... H04R 19/04
257/416
2016/0241965 A1* 8/2016 Chau ..... H04R 19/005

* cited by examiner

MICROPHONE AND MANUFACTURE THEREOF

CROSS-REFERENCE TO RELATED APPLICATION

This application claims priority to and benefit of Chinese Patent Application No. 201710180170.6 filed on Mar. 24, 2017, which is incorporated herein by reference in its entirety.

BACKGROUND

(a) Field of the Invention

This inventive concept relates generally to semiconductor techniques, and more specifically, to a microphone and its manufacturing method.

(b) Description of the Related Art

Silicon-On-Insulator (SOI) films are commonly used in microphone manufacturing processes to improve the sensitivity of the microphone. In a microphone manufacturing process, an SOI film may be used as an electrode film after silicon oxide is removed by, for example, Buffer Oxide Etching (BOE). However, with silicon oxide removed, the SOI film is susceptible to damage.

FIG. 1A shows a schematic sectional view of a microphone in a conventional microphone manufacturing method. Referring to FIG. 1A, the microphone comprises a substrate 11, an insulation layer 12, an SOI film 13, a first contact component 14, and a second contact component 15. In a microphone manufacturing process, the SOI film 13 is bonded with the substrate 11 that has an insulation layer 12 on it, and a Chemical Mechanical Planarization (CMP) process is conducted on the insulation layer 12 before the bonding. However, a plurality of notches on the substrate may adversarially affect the surface uniformity of the insulation layer 12 after the CMP process and result in insufficient bonding power and uneven stress between the insulation layer 12 and the SOI film 13, which renders the SOI film susceptible to damage after BOE.

SUMMARY

The inventors of this inventive concept investigated the issues in conventional techniques and proposed an innovative solution that remedies at least some limitations of the conventional methods.

This inventive concept first presents a microphone, comprising:

a substrate, comprising:

an opening;

a first electrode layer at the bottom of the opening; and at least one groove adjacent to the first electrode layer, wherein the groove and the opening are on two opposing sides of a bottom surface of the first electrode layer;

a separation material layer filling the groove; and a second electrode layer on the separation material layer, wherein the first electrode layer, the separation material layer, and the second material layer form a cavity.

Additionally, in the aforementioned microphone, the first electrode layer may comprise a plurality of first through-holes connecting the opening and the cavity, and being surrounded by the groove.

Additionally, in the aforementioned microphone, the first through-holes may be either completely or partially surrounded by the groove.

Additionally, in the aforementioned microphone, the groove may have a circular or a polygon shape.

Additionally, in the aforementioned microphone, the depth of the groove may be in a range of 4000 angstrom to 5000 angstrom, the width of the groove may be in a range of 40 μm to 50 μm, and the thickness of the separation material layer may be greater than the depth of the groove.

Additionally, the aforementioned microphone may further comprise:

a first contact component on the substrate; and a second contact component on the second electrode layer.

Additionally, the aforementioned microphone may further comprise one or more block components going through the second electrode layer and separating the first electrode layer and the second electrode layer.

Additionally, in the aforementioned microphone, each of the block components may comprise:

a first component going through the second electrode layer and a second component on the first component, wherein the width of the second component is greater than the width of the first component, and a bottom surface of the first component is lower than a bottom surface of the second electrode layer.

Additionally, in the aforementioned microphone, the second electrode layer may comprise one or more second through-holes going through the second electrode layer and connecting to the cavity.

Additionally, the aforementioned microphone may further comprise an insulation layer located between the second electrode layer and the separation material layer, and bonded to the separation material layer.

This inventive concept further presents a microphone manufacturing method, comprising:

providing a first semiconductor structure, comprising a substrate that has at least one groove, and a separation material layer on the substrate filling the groove;

providing a second semiconductor structure, comprising a second electrode layer;

bonding the first semiconductor structure with the second semiconductor structure, with the separation material layer separating the second electrode layer and the substrate;

forming an opening by etching the back side of the substrate;

forming a first electrode layer at the bottom of the opening, with the opening and the groove on two opposing sides of a bottom surface of the first electrode layer; and removing at least a portion of the separation material layer outside the groove, so that the first electrode layer, the separation material layer on the groove, and the second electrode layer form a cavity.

Additionally, in the aforementioned method, the first electrode layer may comprise:

a plurality of first through-holes connecting the opening and the cavity, and being surrounded by the groove.

Additionally, in the aforementioned method, providing a first semiconductor structure may comprise:

providing a substrate;

forming at least one groove on the substrate;

forming a plurality of notches by patterning the substrate, wherein the notches are surrounded by the groove;

forming a separation material layer on the substrate, with a portion of the separation material layer filling the groove, and another portion of the separation material layer on the side wall and the bottom of the notches; and conducting a planarization process on the separation material layer.

Additionally, in the aforementioned method, when etching the back side of the substrate, the opening may expose the separation material layer in the notches, and when removing at least a portion of the separation material layer outside the groove, the separation material layer in the notches may also be removed so that the first through-holes connecting the opening and the cavity are formed.

Additionally, in the aforementioned method, the first through-holes may be either completely or partially surrounded by the groove.

Additionally, in the aforementioned method, the groove may have a circular or a polygon shape.

Additionally, in the aforementioned method, the depth of the groove may be in a range of 4000 angstrom to 5000 angstrom, the width of the groove may be in a range of 40 μm to 50 μm, and the thickness of the separation material layer may be greater than the depth of the groove.

Additionally, in the aforementioned method, the second semiconductor structure may further comprise a first insulation layer, with the second electrode layer on the first insulation layer, and the aforementioned method may further comprise, after the first semiconductor structure is bonded with the second semiconductor structure and before etching the back side of the substrate to form an opening, removing the first insulation layer and conducting a thickness reduction process on the second electrode layer.

Additionally, in the aforementioned method, bonding the first semiconductor structure with the second semiconductor structure may comprise: forming a second insulation layer on the second electrode layer; and bonding the second insulation layer with the separation material layer, and when removing at least a portion of the separation material layer outside the groove, a portion of the second insulation layer may also be removed to form the cavity.

Additionally, the aforementioned method may further comprise: after conducting a thickness reduction process on the second electrode layer and before etching the back side of the substrate to form an opening, forming a first contact component on the substrate and a second contact component on the second electrode layer.

Additionally, the aforementioned method may further comprise: forming one or more block components going through the second electrode layer when forming the first contact component and the second contact component, with the block components separating the first electrode layer and the second electrode layer.

Additionally, in the aforementioned method, each of the block component may comprise:

a first component going through the second electrode layer and a second component on the first component, wherein the width of the second component is greater than the width of the first component, and a bottom surface of the first component is lower than a bottom surface of the second electrode layer.

Additionally, in the aforementioned method, when forming the first contact component and the second contact component, one or more second through-holes going through the second electrode layer and connecting to the separation material layer may be formed, and the cavity may be formed by removing a portion of the separation material layer by injecting an etching agent through the second through-holes.

BRIEF DESCRIPTION OF THE DRAWINGS

The accompanying drawings, which are incorporated herein and constitute a part of the specification, illustrate different embodiments of the inventive concept and, together with the detailed description, serve to describe more clearly the inventive concept.

DETAILED DESCRIPTION OF THE EMBODIMENTS

Figure 1A:
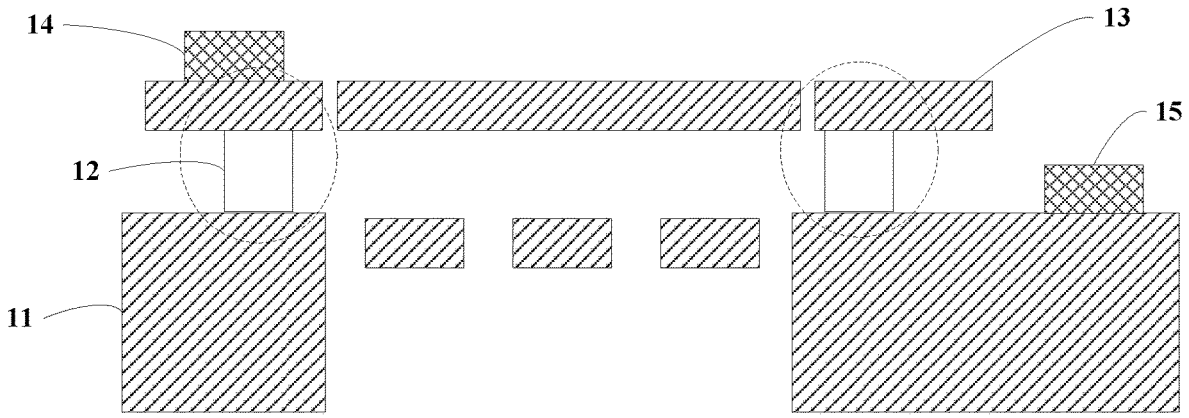
FIG. 1A shows a schematic sectional view of a microphone in a conventional microphone manufacturing method.

Example embodiments of the inventive concept are described with reference to the accompanying drawings. As those skilled in the art would realize, the described embodiments may be modified in various ways without departing from the spirit or scope of the inventive concept. Embodiments may be practiced without some or all of these specified details. Well known process steps and/or structures may not be described in detail, in the interest of clarity.

The drawings and descriptions are illustrative and not restrictive. Like reference numerals may designate like (e.g., analogous or identical) elements in the specification. To the extent possible, any repetitive description will be minimized.

Relative sizes and thicknesses of elements shown in the drawings are chosen to facilitate description and understanding, without limiting the inventive concept. In the drawings, the thicknesses of some layers, films, panels, regions, etc., may be exaggerated for clarity.

Embodiments in the figures may represent idealized illustrations. Variations from the shapes illustrated may be possible, for example due to manufacturing techniques and/or tolerances. Thus, the example embodiments shall not be construed as limited to the shapes or regions illustrated herein but are to include deviations in the shapes. For example, an etched region illustrated as a rectangle may have rounded or curved features. The shapes and regions illustrated in the figures are illustrative and shall not limit the scope of the embodiments.

Although the terms "first," "second," etc. may be used herein to describe various elements, these elements shall not be limited by these terms. These terms may be used to distinguish one element from another element. Thus, a first element discussed below may be termed a second element without departing from the teachings of the present inventive concept. The description of an element as a "first" element may not require or imply the presence of a second element or other elements. The terms "first," "second," etc.

may also be used herein to differentiate different categories or sets of elements. For conciseness, the terms "first," "second," etc. may represent "first-category (or first-set)," "second-category (or second-set)," etc., respectively.

If a first element (such as a layer, film, region, or substrate) is referred to as being "on," "neighboring," "connected to," or "coupled with" a second element, then the first element can be directly on, directly neighboring, directly connected to or directly coupled with the second element, or an intervening element may also be present between the first element and the second element. If a first element is referred to as being "directly on," "directly neighboring," "directly connected to," or "directly coupled with" a second element, then no intended intervening element (except environmental elements such as air) may also be present between the first element and the second element.

Spatially relative terms, such as "beneath," "below," "lower," "above," "upper," and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientation), and the spatially relative descriptors used herein shall be interpreted accordingly.

The terminology used herein is for the purpose of describing particular embodiments and is not intended to limit the inventive concept. As used herein, singular forms, "a," "an," and "the" may indicate plural forms as well, unless the context clearly indicates otherwise. The terms "includes" and/or "including," when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as what is commonly understood by one of ordinary skill in the art related to this field. Terms, such as those defined in commonly used dictionaries, shall be interpreted as having meanings that are consistent with their meanings in the context of the relevant art and shall not be interpreted in an idealized or overly formal sense unless expressly so defined herein.

The term "connect" may mean "electrically connect." The term "insulate" may mean "electrically insulate."

Unless explicitly described to the contrary, the word "comprise" and variations such as "comprises," "comprising," "include," or "including" may imply the inclusion of stated elements but not the exclusion of other elements.

Various embodiments, including methods and techniques, are described in this disclosure. Embodiments of the inventive concept may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the inventive concept may also cover apparatuses for practicing embodiments of the inventive concept. Such apparatus may include circuits, dedicated and/or programmable, to carry out operations pertaining to embodiments of the inventive concept. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the inventive concept.

This inventive concept is described below in reference to the accompanying drawings.

Figure 1B:
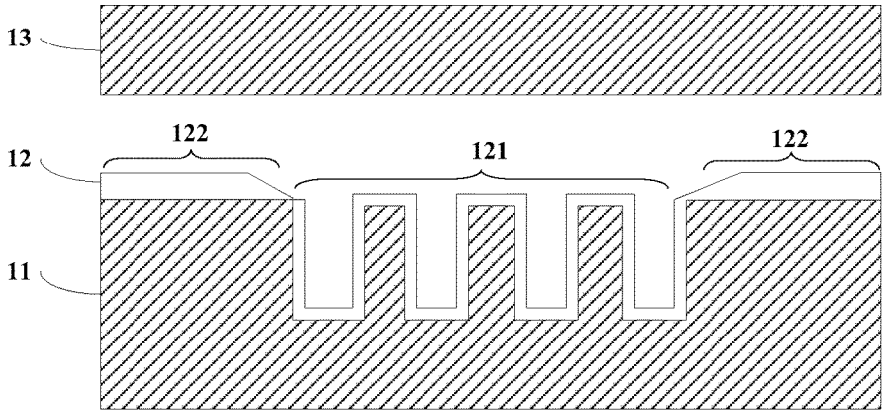
FIG. 1B shows a schematic sectional view illustrating one stage of a conventional microphone manufacturing method.

Referring to FIG. 1B, in a conventional microphone manufacturing process, an SOI film 13 is bonded with a substrate 11 that has an insulation layer 12 on it, and a CMP process is conducted on the insulation layer 12 on the substrate 11 before the bonding. However, a plurality of notches on the substrate may cause discrepancy in pattern density and lead to different grinding speeds in the CMP process, which undermines surface uniformity. For example, a first component 121 of the insulation layer 12 located near the notches may be lower than the second component 122 of the insulation layer 12 located away from the notches by 1000 Å. The lack of surface uniformity results in insufficient bonding power and uneven stress when the SOI film 13 is bonded with the substrate 11. For example, the SOI film 13 may have uneven stress in the circled regions shown in FIG. 1A. These issues, along with the defects that may exist in the bonding area, render the SOI film 13 susceptible to damage after BOE.

Figure 2:
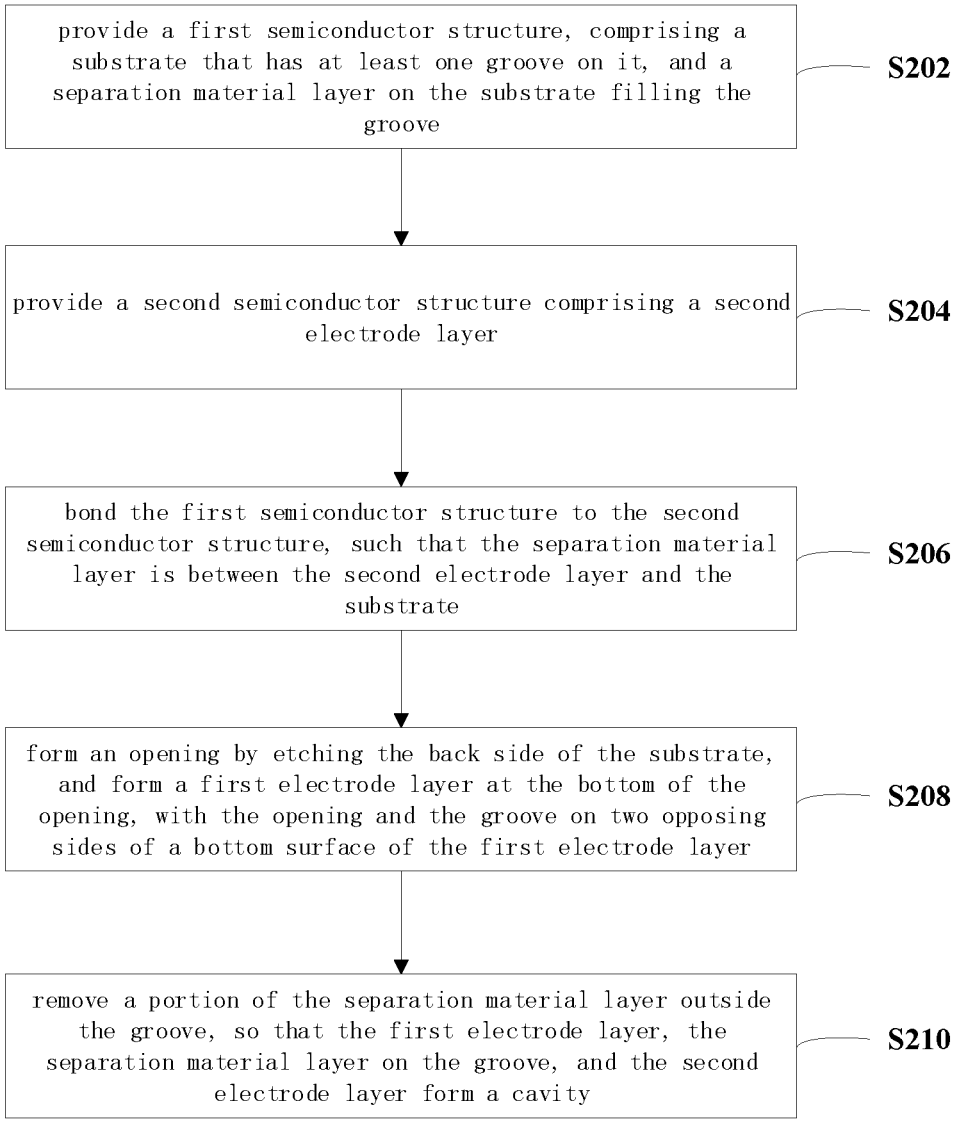
FIG. 2 shows a flowchart illustrating a microphone manufacturing method in accordance with one or more embodiments of this inventive concept.

FIG. 2 shows a flowchart illustrating a microphone manufacturing method in accordance with one or more embodiments of this inventive concept.

In step S202, provide a first semiconductor structure comprising a substrate that has at least one groove on it, and a separation material layer on the substrate filling the groove.

Optionally, step S202 may further comprise providing a substrate such as a silicon substrate.

Optionally, step S202 may further include forming at least one groove on the substrate. The groove may be formed on the substrate through lithography or an etching process. Observed along a top-to-bottom direction with respect to the substrate, the groove may have a circular or a polygon (such as a quadrilateral, a pentagon, or a hexagon) shape, the groove may have other shapes as well. As an example, the depth of the groove may be in a range of 4000 angstrom to 5000 angstrom (e.g., 4500 angstrom), and the width of the groove may be in a range of 40 μm to 50 μm (e.g., 45 μm).

Optionally, step S202 may further include forming a plurality of notches by patterning the substrate, with the notches being surrounded by the groove. In this embodiment, the notches are formed by patterning a portion of the substrate surrounded by the groove, so that the resulting notches will also be surrounded by the groove. The notches may be either completely or partially surrounded by the groove.

Optionally, step S202 may further include forming a separation material layer on the substrate, with a portion of the separation material layer filling the groove, and another portion of the separation material layer formed on the side wall and the bottom of the notches. For example, the separation material layer may be made of a silicon-based oxide, such as silicon dioxide. In one embodiment, the thickness of the separation material layer may be greater than the depth of the groove.

Optionally, step S202 may further include conducting a planarization process (such as a CMP process) on the separation material layer.

Since the notches are surrounded by the groove, a portion of the separation material layer will fill the groove. Hence, during the planarization process on the separation material layer, the grinding speed near the groove is the same as or similar to the grinding speed near the notches, which improves the surface uniformity of the separation material layer.

In step S204, a second semiconductor structure including a second electrode layer is provided.

In step S206, the first semiconductor structure is bonded to the second semiconductor structure, with the separation material layer separating the second electrode layer and the substrate.

In step S208, an opening is formed by etching the back side of the substrate, and form a first electrode layer at the bottom of the opening, with the opening and the groove on two opposing sides of a bottom surface of the first electrode layer. In this step, the opening exposes a portion of the separation material layer in the notches.

In step S210, a portion of the separation material layer outside the groove is removed, so that the first electrode layer, the separation material layer on the groove, and the second electrode layer form a cavity. In this step, the separation material layer inside the notches may also be removed to form a plurality of first through-holes connecting the opening and the cavity. Thus, in this step, the first electrode layer may further include: a plurality of first through-holes connecting the opening and the cavity. The first through-holes are either completely or partially surrounded by the groove.

In the embodiment described above, a groove is formed on the substrate and a separation material layer is formed on the groove and the notches. Thus, the separation material layer has an improved surface uniformity during the planarization process, which leads to better bonding quality between the first semiconductor structure and the second semiconductor structure as a result of improved bonding power and more homogeneous stress. When forming the cavity, a portion of the separation material layer may work as an anchor node embedding in the substrate to increases the effective contact area and the bonding power, and to improve the bonding quality between the second electrode layer and the substrate, which results in a strengthened second electrode layer.

It should be understood that the order of different procedures in this manufacturing method presented above is for description purpose only and is not intended to limit the scope of this inventive concept. Unless explicitly mentioned, the order of different procedures is not limited to the order described above. For example, step S204 does not have to be conducted after step S202, it may be conducted before step S202 as well.

FIGS. 3, 4, 5, 6, 7, 8, 9, 10, 11, 12, and 13 show schematic sectional views illustrating different stages of a microphone manufacturing method in accordance with one or more embodiments of this inventive concept. FIG. 14A shows a top plan view illustrating the grooves formed on the substrate in a microphone manufacturing method in accordance with one embodiment of this inventive concept, and FIG. 14B shows a top plan view illustrating the grooves formed on the substrate in a microphone manufacturing method in accordance with another embodiment of this inventive concept.

A microphone manufacturing method in accordance with this inventive concept is described below in references to these drawings.

Figure 3:
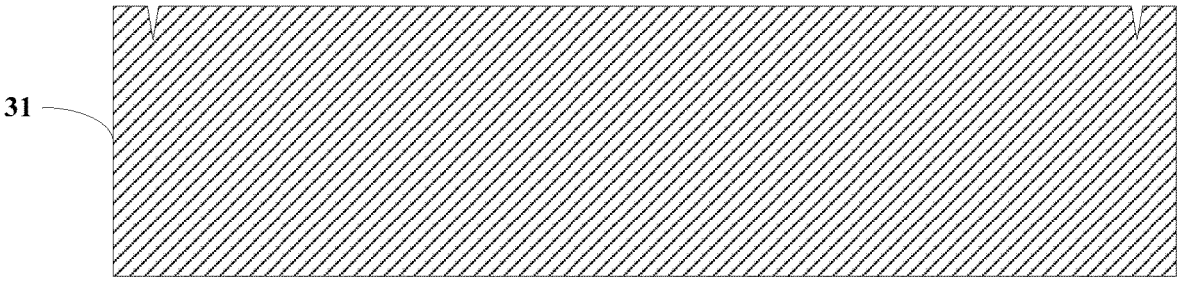
FIGS. 3, 4, 5, 6, 7, 8, 9, 10, 11, 12, and 13 show schematic sectional views illustrating different stages of a microphone manufacturing method in accordance with one or more embodiments of this inventive concept.

First, referring to FIG. 3, a substrate 31 is provided. By lithography or an etching process, an alignment mark may be formed on the substrate 31 near an area a first electrode layer (which may work as a vibration film) will be formed. The alignment mark facilitates the alignment between a first semiconductor structure and a second semiconductor structure in succeeding stages.

Figure 4:
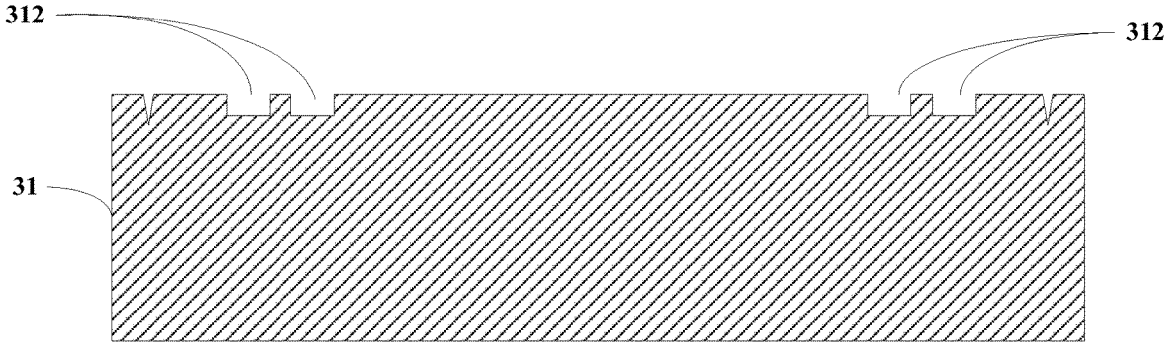

Next, referring to FIG. 4, the substrate 31 is patterned by, for example, lithography or an etching process to form at least one groove 312 on the substrate 31. Observed along a top-to-bottom direction with respect to the substrate 31, the groove 312 may have a circular or a polygon (such as a quadrilateral, a pentagon, or a hexagon) shape. The groove 312 may have other shapes as well.

Figure 5:
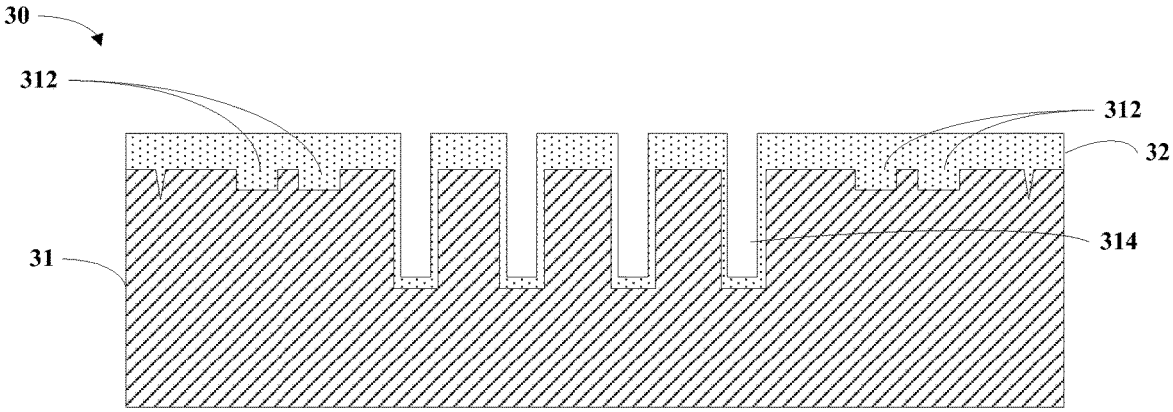

Next, referring to FIG. 5, the substrate 31 is patterned to form a plurality of notches 314 that is surrounded by the groove 312. For example, a portion of the substrate 31 being surrounded by the groove 312 may be patterned to form a plurality of notches 314, so that the resulted notches 314 are also surrounded by the groove 312. The notches 314 may be either completely surrounded, as shown in FIG. 14A, or partially surrounded, as shown in FIG. 14B, by the groove 312.

Next, referring to FIG. 5, a separation material layer 32 is formed on the substrate 31, with a portion of the separation material layer 32 filling the groove 312, and another portion of the separation material layer 32 formed on the side wall and the bottom of the notches 314. The thickness of the separation material layer 32 may be greater than the depth of the groove 312, so that the separation material layer 32 may completely fill the groove 312. Optionally, after the separation material layer 32 is formed, an annealing process and a cleaning process may be conducted on the surface of the separation material layer 32.

Next, a planarization process is conducted on the separation material layer 32 to form a first semiconductor structure 30 as shown in FIG. 5. Optionally, after the planarization process, an annealing process and a cleaning process may be conducted on the surface of the separation material layer 32. Optionally, after the cleaning process, another planarization process may be conducted to further level the surface of the separation material layer 32. Next, an optional pre-cleaning process may be conducted on the separation material layer 32 to prepare it for bonding with a second semiconductor structure.

Figure 6:
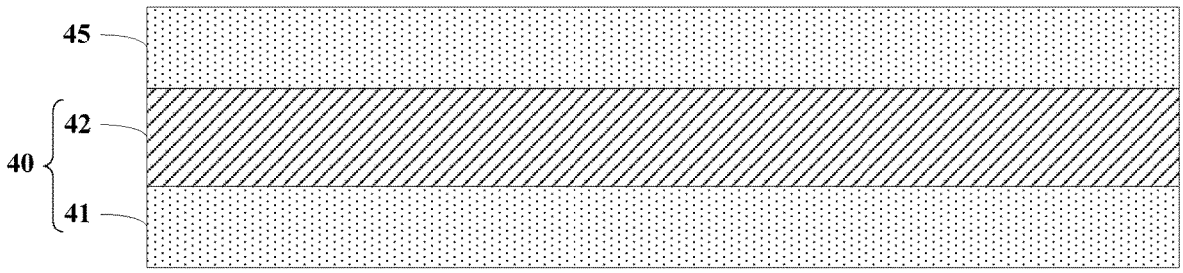

Next, referring to FIG. 6, a second semiconductor structure 40 comprising a second electrode layer 42 is provided. The second semiconductor structure 40 may further comprise a first insulation layer 41, with the second electrode layer 42 on the first insulation layer 41. For example, the second semiconductor structure 40 may be a Silicon-On-Insulator (SOI) film. In this step, providing a second semiconductor structure 40 may further comprise: defining a target area using lithography; removing photoresist; conducting an enhanced wet cleaning process on the surface of the second electrode layer 42; and conducting a pre-cleaning process on the surface of the second electrode layer 42 to prepare it for bonding with the first semiconductor structure.

Figure 7:
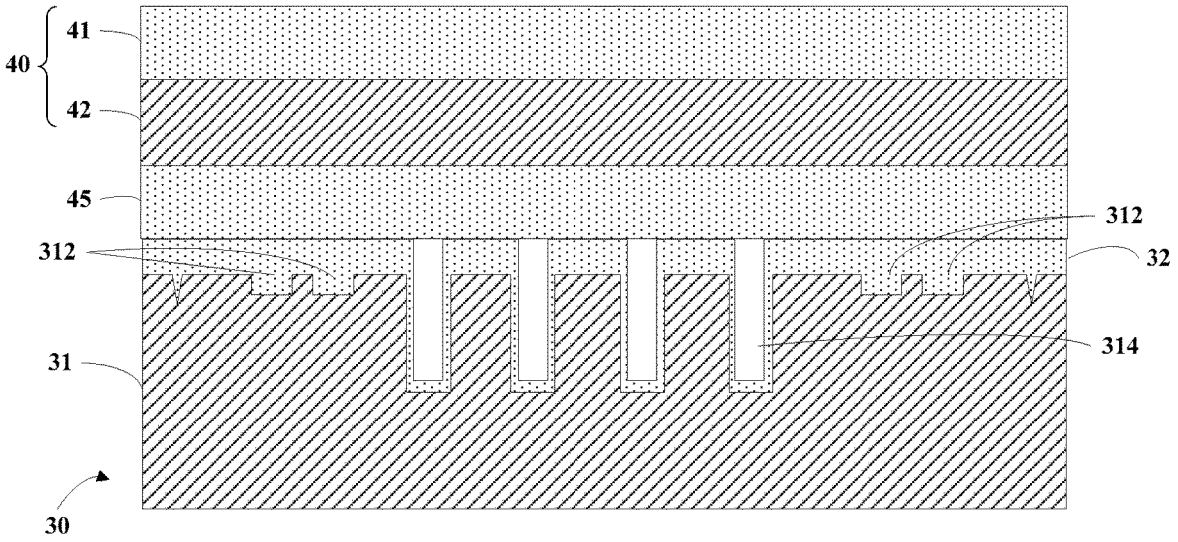

Next, the first semiconductor structure 30 is bonded to the second semiconductor structure 40. Referring to FIG. 6, optionally, this step may further include forming a second insulation layer 45 on the second electrode layer 42. Referring to FIG. 7, optionally, this step may further include bonding the second insulation layer 45 to the separation material layer 32, such that the separation material layer 32 and the second insulation layer 45 are between the second electrode layer 42 and the substrate 31. The second insulation layer 45 and the separation material layer 32 may be made of a same material, such as silicon dioxide. That allows simultaneous removal of a portion of the second insulation layer 45 when removing a portion of the separation material layer 32 to form a cavity in succeeding stages.

Figure 8:
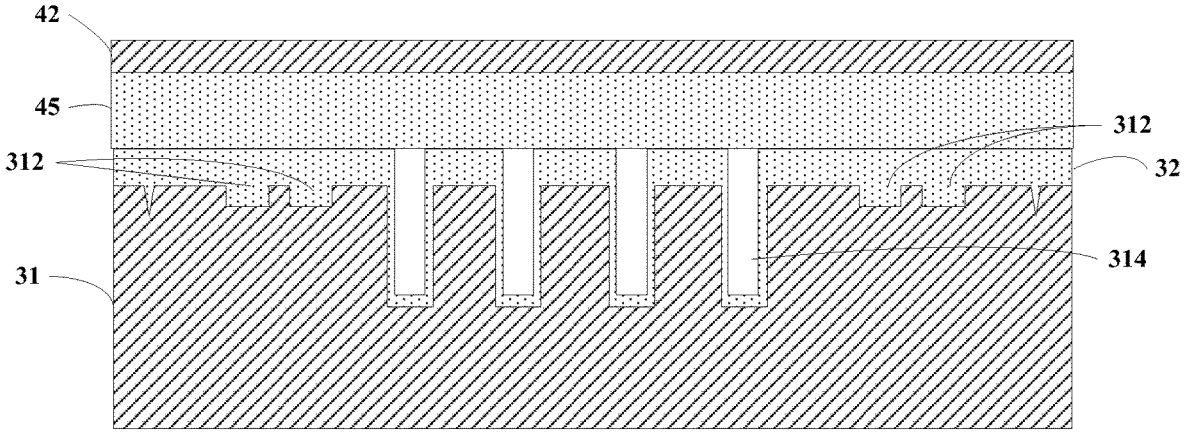

Next, referring to FIG. 8, the first insulation layer 41 is removed and a thickness reduction process is conducted on the second electrode layer 42. The thickness of the second electrode layer 42 after the thickness reduction process may be in a range of 1.7 μm to 3.3 μm (e.g., 2 μm or 2.5 μm).

Next, a first contact component is formed on the substrate 31 and a second contact component is formed on the second electrode layer 42. In this step, one or more second through-holes going through the second electrode layer 42 and connecting the separation material layer are formed. Optionally, in this step, one or more block components going through the second electrode layer 42 are also formed, with the block components separating the first electrode layer and the second electrode layer 42. A detailed description of this step is present below with reference to FIGS. 9, 10, and 11.

Figure 9:
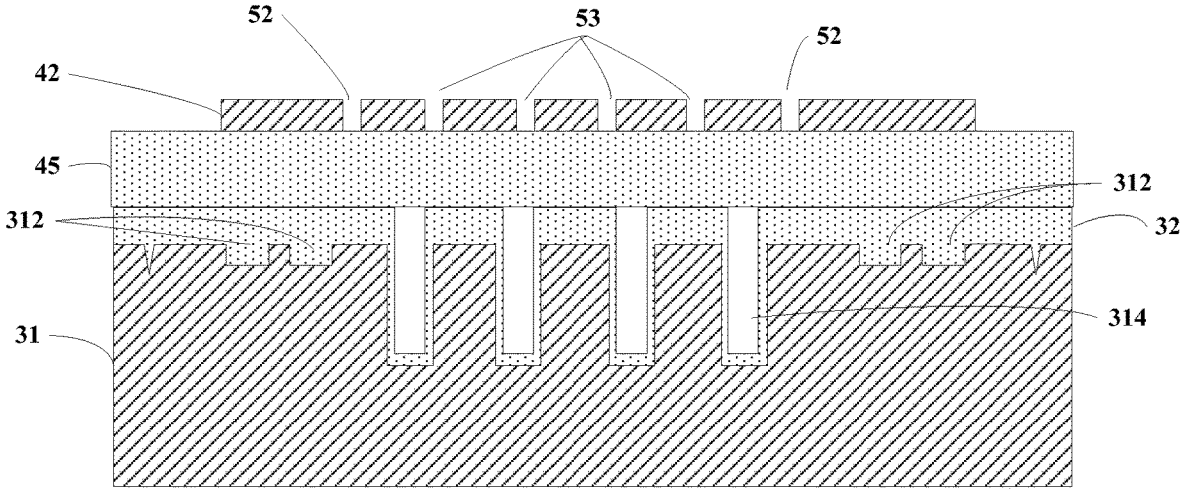
Figure 10:
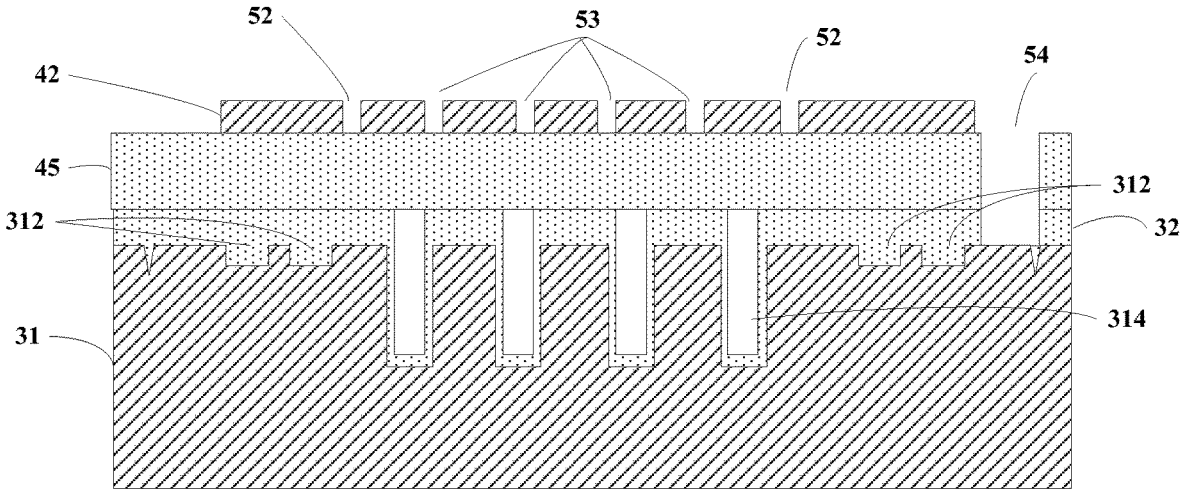

Referring to FIG. 9, the second electrode layer 42 may be patterned to expose at least a portion of the second insulation layer 45 and to form one or more second through-holes 52 and third through-holes 53 going through the second electrode layer 42. Next, referring to FIG. 10, a portion of exposed second insulation layer 45 and a corresponding portion of the separation material layer 32 underneath are etched to form a fourth through-hole 54 exposing a portion of the substrate 31. Next, referring to FIG. 11, a first contact component 61 is formed on the substrate 31 and in the fourth through-hole 54, and a second contact component 62 is formed on the second electrode layer 42. The first contact component 61 and the second contact component 62 may be made of a metallic material such as copper or aluminum. In this step, one or more block components 70 going through the second electrode layer 42 may be formed via the third through-holes 53.

Figure 11:
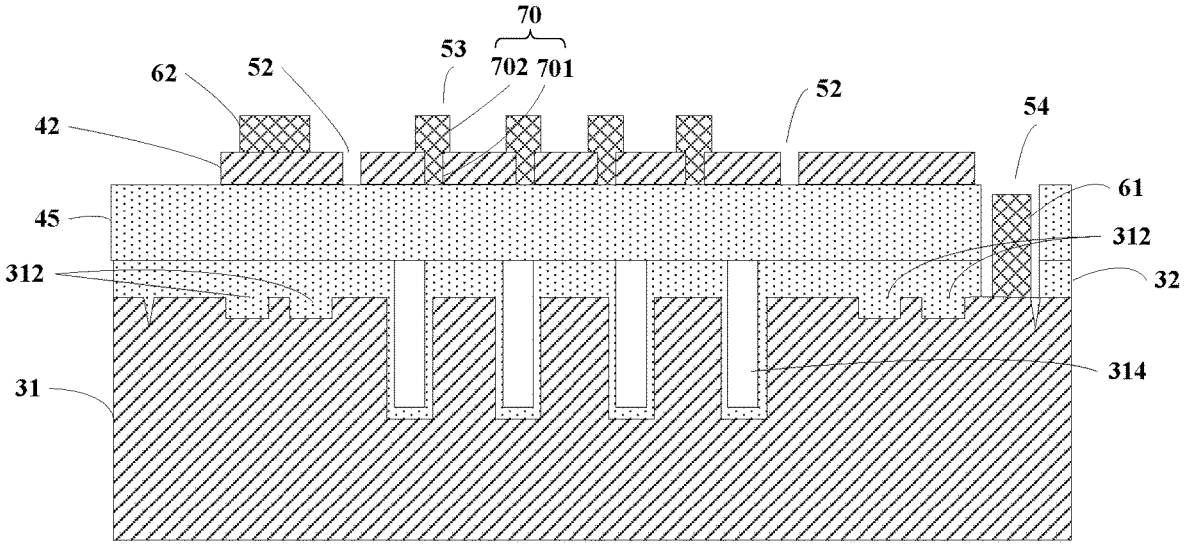

Referring to FIG. 11, each of the block components 70 may comprise a first component 701 going through the second electrode layer 42 and a second component 702 on the first component 701. The width of the second component 702 may be greater than the width of the first component 701. In some embodiments, a bottom surface of the first component 701 is lower than a bottom surface of the second electrode layer 42, so that a bottom part of the first component 701 can extend underneath the second electrode layer 42, which prevents the second electrode layer 42 from adhering to a first electrode layer that will be formed in succeeding stages. In one embodiment, the block components 70 may be made of a same material as the first contact component 61 and the second contact component 62. For example, the block components 70 may be made of a metallic material such as copper or aluminum. The block components 70 may also be made of a different material. For example, when a cavity is formed, original block components 70 may be removed and replaced by a new block component made of a different material such as silicon nitride.

Figure 12:
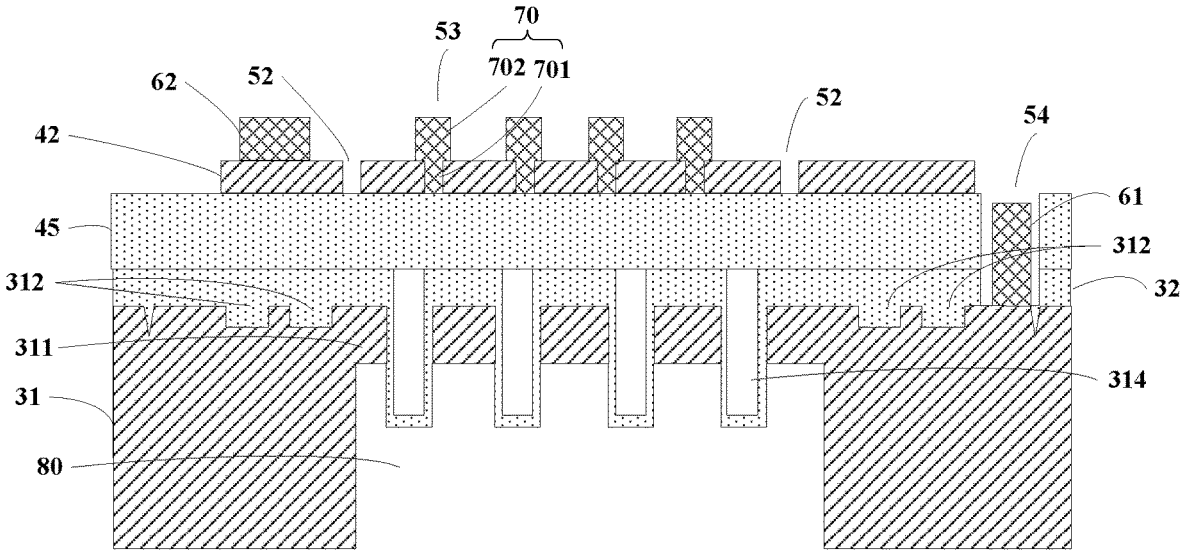

Next, referring to FIG. 12, an opening 80 is formed by etching the back side of the substrate 31. A first electrode layer 311 adjacent to the groove 312 is formed at the bottom of the opening 80, with the opening 80 and the groove 312 on two opposing sides of a bottom surface of the first electrode layer 311. In this step, the opening 80 exposes a portion of the separation material layer 32 in the notches 314.

Figure 13:
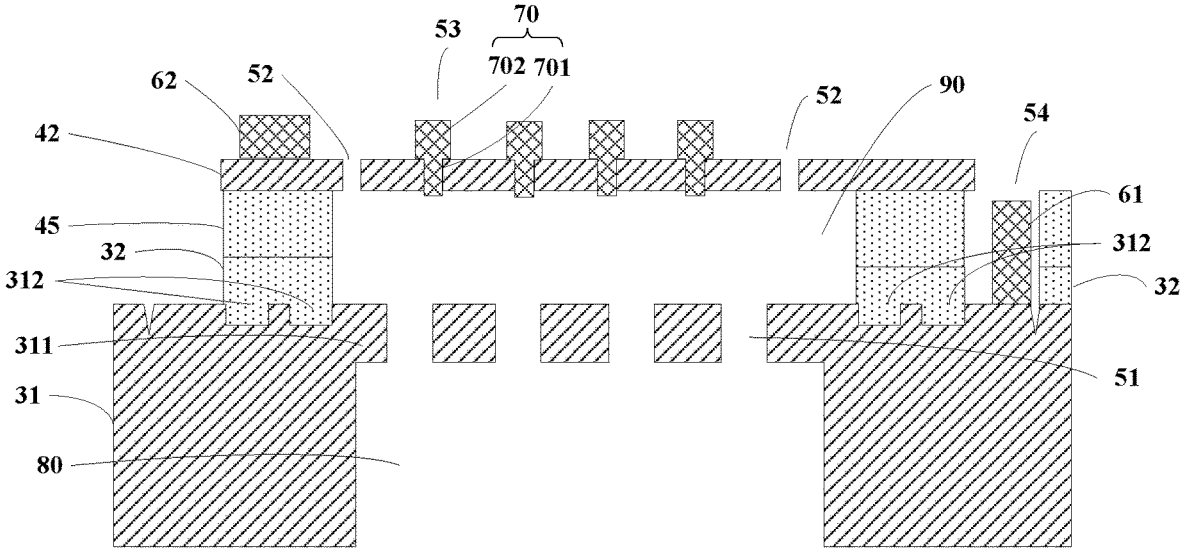
Figure 14A:
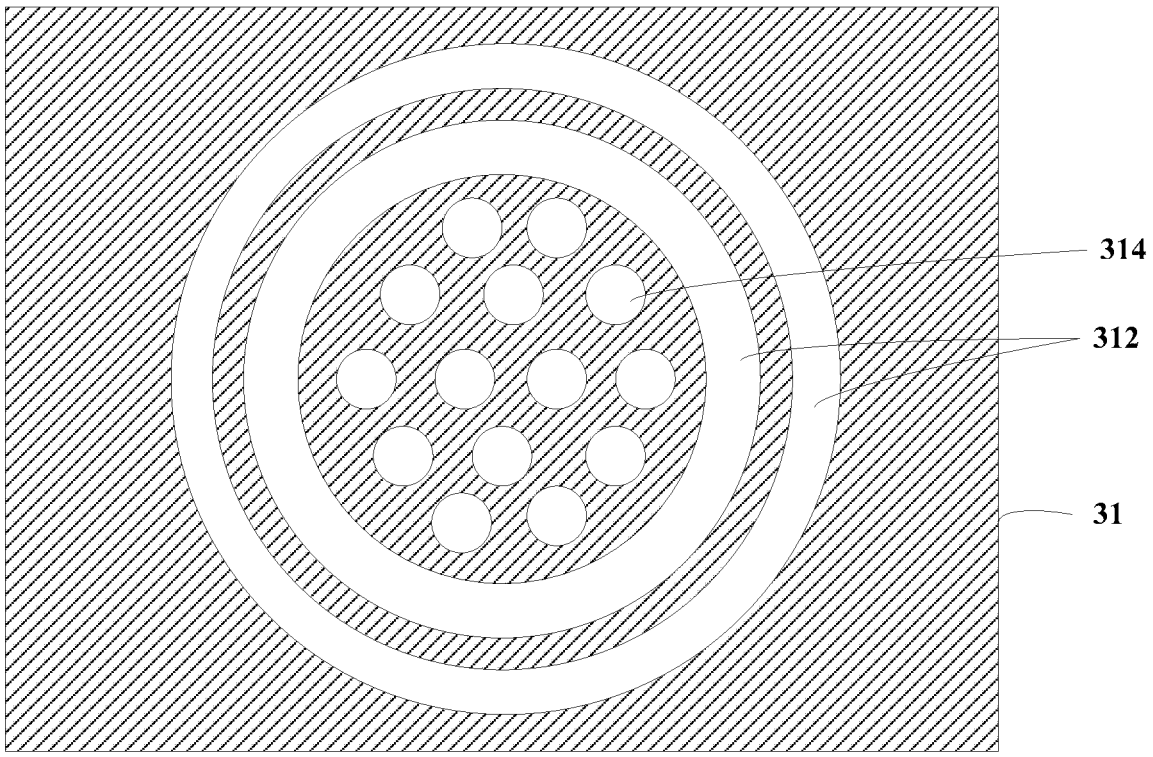
FIG. 14A shows a top plan view illustrating the grooves formed on the substrate in a microphone manufacturing method in accordance with one embodiment of this inventive concept.
Figure 14B:
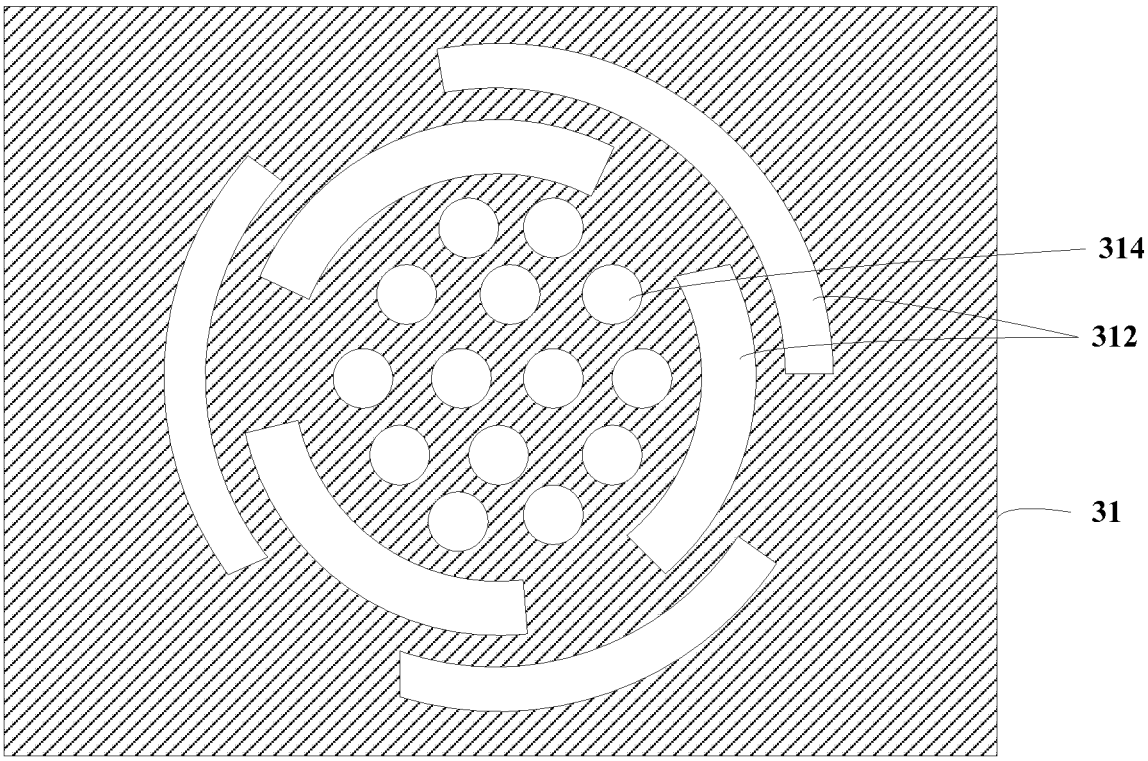
FIG. 14B shows a top plan view illustrating the grooves formed on the substrate in a microphone manufacturing method in accordance with another embodiment of this inventive concept.

Next, referring to FIG. 13, a portion of the separation material layer 32 outside the groove 312 is removed, so that the first electrode layer 311, the separation material layer 32 on the groove 312, and the second electrode layer 42 form a cavity 90. In this step, a portion of the second insulation layer 45 is also removed, so that the first electrode layer 311, the remaining separation material layer 32, the remaining second insulation layer 45, and the second electrode layer 42 may form the cavity 90. For example, the cavity 90 may be formed by injecting an etching agent through the second through-holes 52 to remove a portion of the separation material layer 32 and, if there is any, a portion of the second insulation layer 45. The cavity 90 may be formed by a BOE process.

In the embodiment described above, a groove surrounding the notches are formed on the substrate, thus a portion of the separation layer on the groove may work as an anchor node embedding in the substrate to increase the effective contact area and the bonding power, and to improve the bonding quality between the second electrode layer and the substrate, which results in a strengthened second electrode layer. Additionally, this manufacturing method does not alter the distance between the first electrode layer and the second electrode layer, and therefore the size of the cavity remains intact.

This inventive concept further presents a microphone. Referring to FIG. 13, the microphone comprises a substrate 31 comprising an opening 80, a first electrode layer 311 (may work as a vibration film) at the bottom of the opening 80, and at least one groove 312 adjacent to the first electrode layer 311. The groove 312 and the opening 80 are on two opposing sides of a bottom surface of the first electrode layer 311. Observed along a top-to-bottom direction with respect to the substrate 31, the groove 312 may have a circular or a polygon (such as a quadrilateral, a pentagon, or a hexagon) shape, the groove 312 may have other shapes as well.

The microphone may further comprise a separation material layer 32 filling the groove 312. The separation material layer 32 may be made of a silicon-based oxide, such as silicon dioxide.

The microphone may further comprise a second electrode layer 42 on the separation material layer 32. The first electrode layer 311, the separation material layer 32 and the second electrode layer 42 form a cavity 90.

In the embodiment described above, the separation material layer on the groove may work as an anchor node embedding in the substrate to increase the effective contact area and the bonding power, and to improve the bonding quality between the second electrode layer and the substrate, which results in a strengthened second electrode layer. Additionally, in this microphone, the distance between the first electrode layer and the second electrode layer is not altered, thus the size of the cavity remains intact.

Referring to FIG. 13, in one embodiment, the first electrode layer 311 may comprise a plurality of first through-holes 51 connecting the opening 80 and the cavity 90, with the first through-holes 51 being either completely or partially surrounded by the groove 312.

In one embodiment, the depth of the groove 312 may be in a range of 4000 angstrom to 5000 angstrom (e.g., 4500 angstrom), the width of the groove 312 may be in a range of 40 μm to 50 μm (e.g., 45 μm). The depth of the separation material layer 32 may be greater than the depth of the groove 312.

Referring to FIG. 13, in one embodiment, the microphone may further comprise an insulation layer 45 (i.e., the second insulation layer described above) located between the second electrode layer 42 and the separation material layer 32, and bonded with the separation material layer 32. The insulation layer 45 and the separation material layer 32 may be made of the same material, such as silicon dioxide. In this embodiment, the first electrode layer 311, the separation material layer 32, the insulation layer 45, and the second electrode layer 42 form a cavity 90. Optionally, a fourth through-hole 54 exposing a portion of the substrate 31 may be formed in the insulation layer 45 and the separation material layer 32.

Referring to FIG. 13, in one embodiment, the microphone may further comprise a first contact component 61 on the substrate 31 and in the fourth through-hole 54, and a second contact component 62 on the second electrode layer 42.

Referring to FIG. 13, in one embodiment, the second electrode layer 42 may comprise one or more second through-holes 52 going through the second electrode layer 42 and connecting the cavity 90. Optionally, the second electrode layer 42 may further comprise one or more third through-holes 53 going through the second electrode layer 42 and connecting the cavity 90.

Referring to FIG. 13, in one embodiment, the microphone may further comprise one or more block components 70 going through the second electrode layer 42 and separating the first electrode layer 311 and the second electrode layer 42. For example, the block components 70 may be made of an insulation material such as silicon nitride or a metallic material such as copper or aluminum. Each of the block components 70 may comprise a first component 701 going through the second electrode layer 42 (the first component 701 is formed in the third through-hole 53) and a second component 702 on the first component 701. The width of the second component 702 may be greater than the width of the first component 701. A bottom surface of the first component 701 may be lower than a bottom surface of the second electrode layer 42.

This concludes the description of a microphone and its manufacturing method in accordance with one or more embodiments of this inventive concept. For purposes of conciseness and convenience, some components or procedures that are well known to one of ordinary skills in the art in this field are omitted. These omissions, however, do not prevent one of ordinary skill in the art in this field to make and use the inventive concept herein disclosed.

While this inventive concept has been described in terms of several embodiments, there are alterations, permutations, and equivalents, which fall within the scope of this disclosure. It shall also be noted that there are alternative ways of implementing the methods and/or apparatuses of the inventive concept. Furthermore, embodiments may find utility in other applications. It is therefore intended that the claims be interpreted as including all such alterations, permutations, and equivalents. The abstract section is provided herein for convenience and, due to word count limitation, is accordingly written for reading convenience and shall not be employed to limit the scope of the claims.

What is claimed is:

1. A microphone, comprising:

a substrate, comprising:

an opening;

a first electrode layer, wherein the opening is positioned between a surface of the first electrode layer and a face of the substrate in a first direction, wherein the first direction is perpendicular to the face of the substrate; and a groove set, wherein the surface of the first electrode layer is positioned between the groove set and the opening in the first direction, wherein a depth of the groove set in the first direction is less than a thickness of the first electrode layer in the first direction, wherein the opening is positioned between two portions of the groove set in a second direction, and wherein the second direction is perpendicular to the first direction;

a separation material layer filling the groove set and surrounding a cavity; and a second electrode layer overlapping the separation material layer and overlapping the first electrode layer, wherein the cavity is positioned between the first electrode layer and the second electrode layer in the first direction.

2. The microphone of claim 1, wherein the first electrode layer comprises:

a plurality of first through-holes connecting the opening and the cavity, and being completely or partially surrounded by the groove set.

3. The microphone of claim 1, wherein the groove set has an arc shape, a circular shape, or a polygon shape in a plan view of the microphone.

4. The microphone of claim 1, wherein the depth of the groove set is in a range of 4000 angstrom to 5000 angstrom, the width of the groove set is in a range of 40 μm to 50 μm, and the thickness of the separation material layer is greater than the depth of the groove set.

5. The microphone of claim 1, further comprising:

a first contact component on the substrate; and a second contact component on the second electrode layer.

6. The microphone of claim 1, wherein the second electrode layer comprises:

one or more second through-holes going through the second electrode layer and connecting to the cavity.

7. The microphone of claim 1, further comprising:

an insulation layer located between the second electrode layer and the separation material layer, and bonded to the separation material layer.

8. A microphone, comprising:

a substrate, comprising:

an opening;

a first electrode layer, wherein the opening is positioned between a surface of the first electrode layer and a face of the substrate in a first direction, wherein the first direction is perpendicular to the face of the substrate; and a groove, wherein the surface of the first electrode layer is positioned between the groove and the opening in the first direction;

a separation material layer filling the groove and surrounding a cavity;

a second electrode layer overlapping the separation material layer and overlapping the first electrode layer, wherein the cavity is positioned between the first electrode layer and the second electrode layer in the first direction; and one or more block components going through the second electrode layer and being partially exposed by the second electrode layer to the cavity.

9. The microphone of claim 8, wherein each of the block components comprises:

a first component going through the second electrode layer and a second component on the first component, wherein a surface of the second component is wider than a surface of the first component, and the surface of the first component is closer to the first electrode layer than the surface of the second electrode layer.

* * * * *